United States Patent [19]

Böhm

[11] Patent Number: 4,838,159

[45] Date of Patent: Jun. 13, 1989

[54] LIFTING DEVICE FOR TEMPLATES

[75] Inventor: Walter Böhm, Kirchbichl, Austria

[73] Assignee: Johannes Zimmer Gesellschaft M.B.H., Kufstein, Austria

[21] Appl. No.: 207,751

[22] Filed: Jun. 16, 1988

[30] Foreign Application Priority Data

Apr. 12, 1988 [DE] Fed. Rep. of Germany ... 8804950[U]

[51] Int. Cl.[4] ..... B41L 13/00

[52] U.S. Cl. ..... 101/119; 101/127.1; 101/335

[58] Field of Search ..... 101/119, 120, 116, 335, 101/127.1, 128, DIG. 10

[56] References Cited

U.S. PATENT DOCUMENTS 3,312,165 4/1967 Strom ..... 101/119

3,988,985 11/1976 Mitter ..... 101/119

4,510,863 4/1985 Blaak et al. ..... 101/119

4,627,345 12/1986 Watts ..... 101/119

*Primary Examiner*—Eugene H. Eickholt

*Attorney, Agent, or Firm*—Lorusso & Loud

[57] ABSTRACT

Described is a lifting device for cylindrical templates in printing machines, with an inking tube extending through each cylindrical template, the lifting device travelling along a rail running parallel to the direction of the cylindrical template and along a rail travelling in a direction normal thereto and which can be releasably connected to the inking tube. The lifting device is constructed in the form of a hydraulically or pneumatically operated telescopic arm, always in the vertical position, which carries a tong-like gripper (2) for releasable connection with the inking tube (3).

2 Claims, 1 Drawing Sheet

LIFTING DEVICE FOR TEMPLATES

Figure 1:
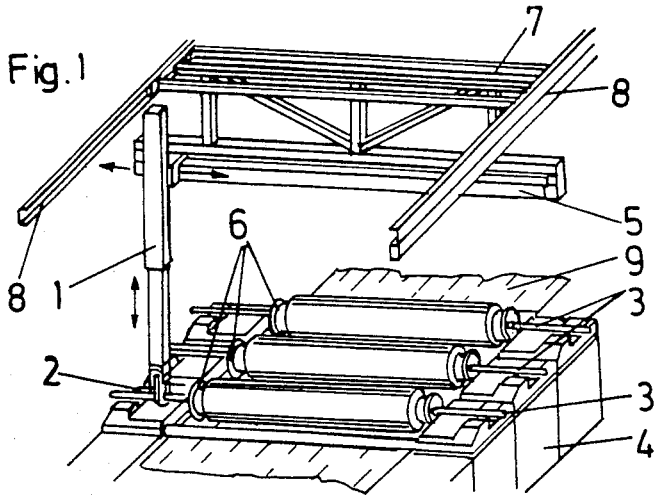

The novelty relates to a lifting device for cylindrical templates in printing machines, with an inking tube extending through each cylindrical template, the lifting device travelling along a rail running parallel to the direction of the cylindrical template and along a rail travelling in a direction normal thereto and which can be releasably connected to the inking tube.

Each time the colour is changed, or whenever the printing machine is inoperative for a longer period of time, it is necessary to pick up the inking tube and the cylindrical template and transport these to a wash installation. To date this is carried out by an operating persons, standing on the side of the cylindrical template facing away from the wash installation, placing a hook, suspended from a travelling chain, on the inking tube and then initiating, through the usual controls, the raising of the hook and a horizontal movement of the chain supporting device. The end of the inking tube closer to the wash installation is lifted out and displaced by a second operating person and finally connected to a carrier arm of the wash installation.

Especially in printing machines of greater width, it would be impossible to control the hooking-on of the carrier hook on the side of the machine which is adjacent to the wash installation because the hook is secured to a swaying chain. For carrying out the complete operation, according to the present state of the art, this reuires two persons. Surprisingly it was revealed that through a relatively simple alteration in the known lifting device it is possible to dispense with one operating person. According to the invention this is achieved by constructing the lifting device in the form of a rigid arm of variable length, always extending in the vertical direction, especially a hydraulically operated telescopic arm, which carries a tong-like gripper for releasable connection with the inking tube.

With a lifting device constructed in this way, the operating person who manipulates the end of the inking tube adjacent the wash installation can synchronously move the other end of the tube by means of the lifting device. The gripping of the inking tube by the lifting device presents no problems: Control cams can ensure that the rail carrying the lifting device stops exactly above the cylindrical template to be moved. Since the telescopic arm does not sway, in contrast to the chains used hitherto, it can be lowered with precision onto the inking tube which, through simple locking of the tong-like gripper, is gripped and retained.

Although in principle it would be possible to automate the entire operation, in which case each end of the inking tube would be provided with a lifting device according to the invention, it is particularly advantageous to provide only one lifting device according to the invention, since one operating person is required for operating in any case. The length of the rail carrying the lifting device in this case does not have to substantially exceed the width of the printing machine.

The operation of the device according to the invention is now explained in more detail with the aid of the drawing, which illustrates three stages in the removal of a cylindrical template from a printing machine.

Figure 2:
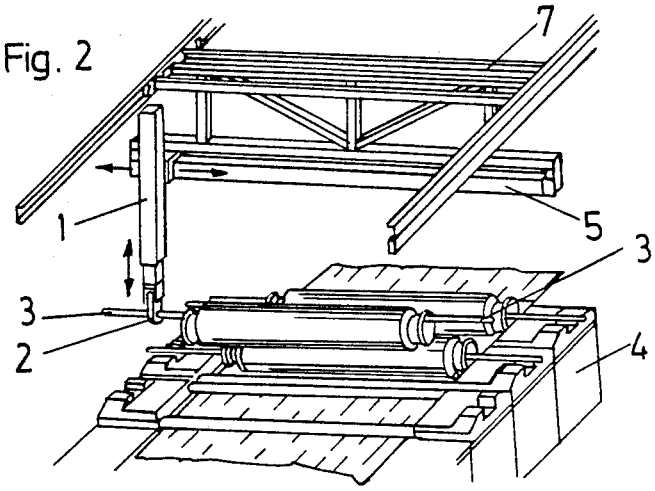
Figure 3:
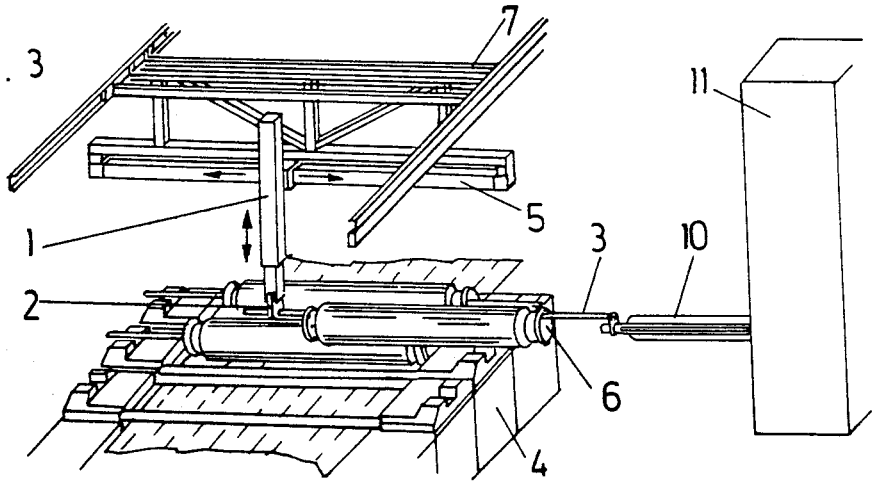

The illustrating printing machine 4 serves to print on a fabric web 9 by means of several printing stations which each have a cylindrical template 6 through which extends on inking tube 3. If a cylindrical template 6 together with the inking tube 3 running through it is to be removed from the printing machine 4, the supporting frame 7 is moved along the longitudinal rails 8 until the rail 5 runs above the respective cylindrical template 6 and displaced slightly sideways from it. If the arm 1 is extended in this position, in which the arm 1 is connected at a rigid angle with the rail 5, the open tong-like gripper 2 automatically encompasses one end of the respective inking tube 3. The tong-like gripper 2 is then closed, resulting in the situation represented by FIG. 1. The inking cylinder 3 is then lifted up by the arm 1 on the one hand, and by an operating person (not shown) on the other hand (FIG. 2) and is then transported into the position according to FIG. 3, in which takes place a coupling of the inking cylinder 3 with the supporting arm 10 of a wash apparatus. The templates 6 can now be advanced over this supporting arm and cleaned in the wash installation 11. The inking cylinder 3 also can be introduced into the wash installation 1 after the operating person has taken possession of the end of the inking tube 3, previously held by the arm 1, which has been completely pushed over to the right.

After the wash is completed, the process continues in the reverse order and the template with the inking tube and revolving doctor is conveyed back into the printing machine, or is put into the template store.

If different to the example shown, the axis of the wash apparatus 11 runs parallel to the longitudinal axis of the machine, it is sensible to arrange the arm 1 together with the tong-like gripper 2 to be rotatable or to arrange the tong-like gripper 2 to be rotatable with respect to the arm 1, so that the inking tube 3 can be pivoted into a position in which it runs parallel to the longitudinal direction of the rail.

What is claimed is:

1. Lifting device for cylindrical templates in printing machines, with an inking tube extending through each cylindrical template, the lifting device travelling along a rail running parallel to the direction of the cylindrical template and along a rail travelling in a direction normal thereto and which can be releasably connected to the inking tube, characterized in that the lifting device is constructed in the form of a rigid arm (1) of variable length, always extending in the vertical direction, especially a hydraulically or pneumatically operated telescopic arm, which carries a tong-like gripper (2) for releasable connection with the inking tube (3).

2. Lifting device according to claim 1, characterised in that the length of the rail (5) does not substantially exceed the width of the printing machine (4).

* * * * *